US007647964B2

(12) United States Patent
Akbar et al.

(10) Patent No.: US 7,647,964 B2
(45) Date of Patent: Jan. 19, 2010

(54) DEGRADABLE BALL SEALERS AND METHODS FOR USE IN WELL TREATMENT

(75) Inventors: Syed Akbar, Houston, TX (US); Patrick R. Okell, Bellaire, TX (US); A. Richard Sinclair, Houston, TX (US)

(73) Assignee: Fairmount Minerals, Ltd., Chardon, OH (US)

( * ) Notice: Subject to any disclaimer, the term of this patent is extended or adjusted under 35 U.S.C. 154(b) by 32 days.

(21) Appl. No.: 11/640,813

(22) Filed: Dec. 18, 2006

(65) Prior Publication Data

US 2007/0169935 A1 Jul. 26, 2007

Related U.S. Application Data

(60) Provisional application No. 60/751,695, filed on Dec. 19, 2005.

(51) Int. Cl.
*E21B 33/12* (2006.01)
*E21B 33/13* (2006.01)

(52) U.S. Cl. ..... 166/193; 166/282; 166/284

(58) Field of Classification Search ..... 524/8, 524/9–12, 15; 166/284, 193, 282, 283
See application file for complete search history.

(56) References Cited

U.S. PATENT DOCUMENTS 2,754,910 A * 7/1956 Derrick et al. ..... 166/284
2,933,136 A * 4/1960 Ayers et al. ..... 166/284
3,645,331 A * 2/1972 Maurer et al. ..... 175/65
4,102,401 A 7/1978 Erbstoesser
4,244,425 A * 1/1981 Erbstoesser ..... 166/284
4,407,368 A 10/1983 Erbstoesser
4,421,167 A 12/1983 Erbstoesser et al.
4,488,599 A * 12/1984 Graham et al. ..... 166/281
4,505,334 A * 3/1985 Doner et al. ..... 166/284
4,582,091 A * 4/1986 Ells ..... 138/97
4,679,629 A * 7/1987 Abdo et al. ..... 166/281
4,702,316 A * 10/1987 Chung et al. ..... 166/272.3
4,987,212 A * 1/1991 Morterol et al. ..... 526/348.4
5,253,709 A * 10/1993 Kendrick et al. ..... 166/284
5,278,272 A 1/1994 Lai et al.
5,309,995 A * 5/1994 Gonzalez et al. ..... 166/284
5,485,882 A * 1/1996 Bailey et al. ..... 166/284
5,990,051 A * 11/1999 Ischy et al. ..... 507/204

(Continued)

OTHER PUBLICATIONS

Erbstoesser, S.R., "Improved Ball Sealer Diversion," Journal of Petroleum Technology, SPE Paper 8401, pp. 1903-1910, 1980, Soc. of Petroleum Eng. of AIME.

(Continued)

*Primary Examiner*—David J Bagnell
*Assistant Examiner*—Cathleen R Hutchins
(74) *Attorney, Agent, or Firm*—Calfee, Halter & Griswold LLP

(57) ABSTRACT

Described is an oil-degradable ball sealer for use in the oil and gas industry. The ball seal comprises a particular composition including ethylene and one or more alpha-olefins, prepared by an injection molding technique to provide a ball sealer which will dissolve in stimulation or wellbore fluids after stimulation operations are complete. The composition, when dissolved into wellbore fluids, does not pose a hazard or problem to aqueous wellbore fluids or further wellbore stimulations.

30 Claims, 5 Drawing Sheets

U.S. PATENT DOCUMENTS

| | | | | |
|---|---|---|---|---|
| 5,990,053 | A * | 11/1999 | Jones et al. | 507/238 |
| 6,328,105 | B1 * | 12/2001 | Betzold | 166/280.2 |
| 6,372,378 | B1 | 4/2002 | Warner et al. | |
| 6,380,138 | B1 * | 4/2002 | Ischy et al. | 507/204 |
| 2004/0014892 | A1 * | 1/2004 | Magg | 525/191 |
| 2005/0019574 | A1 * | 1/2005 | McCrary | 428/403 |
| 2005/0230117 | A1 * | 10/2005 | Wilkinson | 166/308.1 |
| 2005/0288408 | A1 * | 12/2005 | Resendes et al. | 524/261 |
| 2007/0044958 | A1 * | 3/2007 | Rytlewski et al. | 166/250.01 |

OTHER PUBLICATIONS

Gabriel, G.A. et al., "The Design of Buoyant Ball Sealer Treatments," SPE Paper 13085, 1984, Soc. of Petroleum Eng. of AIME.

Bilden et al., "New Water-Soluble Perforation Ball Sealers Provide Enhanced Diversion in Well Completions," SPE Paper 49099, pp. 427-436, 1998, Soc. of Petroleum Eng. of AIME.

* cited by examiner

DEGRADABLE BALL SEALERS AND METHODS FOR USE IN WELL TREATMENT

PRIORITY

This application claims benefit of priority to U.S. Provisional Patent Application Ser. No. 60/751,695, filed Dec. 19, 2005, the entire contents of which are incorporated by reference herein.

FIELD OF THE INVENTION

The invention relates to degradable ball sealer compositions, methods for their manufacture and methods for use in temporarily sealing casing perforations in wellbore stimulation treatments. In particular, oil degradable ball sealers comprised of copolymers of ethylene and one or more alpha-olefins and optionally finely graded filler material for adjusting the ball sealer specific gravity, methods for their manufacture by injection molding, and methods for their use in subterranean stimulation treatments is disclosed.

DESCRIPTION OF RELATED ART

It is common practice in completing oil and gas wells to set a string of pipe, known as casing, in the well and use a cement sheath around the outside of the casing to isolate the various formations penetrated by the well. To establish fluid communication between the hydrocarbon-bearing formations and the interior of the casing, the casing and cement sheath are perforated, typically using a perforating gun or similar apparatus. At various times during the life of the well, it may be desirable to increase the production rate of hydrocarbons using appropriate treating or stimulation fluids such as acids, water-treatment fluids, solvents or surfactants. If only a short, single pay zone in the well has been perforated, the treating fluid will flow into the pay zone where it is needed. As the length of the perforated pay zone or the number of perforated pay zones increases, the placement of the treating or stimulation fluid in the regions of the pay zones where it is needed becomes more difficult. For instance, the strata having the highest permeability will most likely consume the major portion of a given stimulation treatment, leaving the least permeable strata virtually untreated.

Various techniques have been developed to redirect stimulation fluids towards lower permeability zones to ensure that damaged formations are sufficiently exposed to these fluids. One such technique for achieving diversion involves the use of downhole equipment such as packers. Although these devices can be effective, they are quite expensive because of the associated workover equipment required during the tubing-packer manipulations. Additionally, mechanical reliability tends to decrease as the depth of the well increases. As a result, considerable effort has been devoted to the development of alternative diverting methods for cased and perforated wells.

One alternative is to redirect stimulation fluids toward lower permeability zones by using ball sealers to temporarily block perforations that exist across higher permeability zones. Generally, the ball sealers are pumped into the wellbore along with the formation treating fluid and are carried down the wellbore and onto the perforations by the flow of the fluid through the perforations into the formation. The balls seat upon the perforations receiving the majority of fluid flow and, once seated, are held there by the pressure differential across the perforations. The ball sealers are injected at the surface and transported by the treating fluid. Other than a ball injector and possibly a ball catcher, no special or additional treating equipment is required. Some of the advantages of utilizing ball sealers as a diverting agent include ease of use, positive shutoff, no involvement with the formation, and low risk of incurring damage to the well. Ball sealers are typically designed to be chemically inert in the environment to which they are exposed; to effectively seal, yet not extrude into the perforations; and to release from the perforations when the pressure differential into the formation is relieved.

The oil and gas industry began using ball sealers as a diverting agent around 1956. Since that time the majority of wells have been completed at depths less than 15,000 ft, and as a result most commercially available ball sealers are designed to perform at temperatures and at pressures commonly associated with wells of depths less than 15,000 ft. In most cases these wells will have temperatures less than 250° F. and maximum bottomhole pressures not exceeding 10,000 to 15,000 psi during a workover [Erbstoesser, S. R., *Journal of Petroleum Technology*, pp. 1903-1910 (1980)]. In recent years, however, technological developments have enabled the oil and gas industry to drill and complete wells at depths exceeding 15,000 ft., which will often have higher temperatures and pressures. For example, at a depth of around 25,000 ft., wellbore temperatures can exceed 400° F., with bottomhole pressures approaching 20,000 psi during a workover. In addition to the high temperatures and pressures, wells completed at these depths often produce fluids like carbon dioxide ($CO_2$) or hydrogen sulfide ($H_2S$), and the stimulation fluid used may be a solvent like hydrochloric acid (HCl). Thus, conducting a workover using ball sealers in deep, hostile environment wells requires ball sealers capable of withstanding high pressures and temperatures while exposed to gases and solvents. The ball sealers must also resist changes in density to ensure satisfactory seating efficiency during a workover.

Most commercially available ball sealers will have a solid, rigid core which resists extrusion into or through a perforation in the formation and an outer covering sufficiently compliant to seal, or significantly seal, the perforation. The ball sealers should not be able to penetrate the formation since penetration could result in permanent damage to the flow characteristics of the well. Commercially available ball sealers are typically spherical with a hard, solid core made from nylon, phenolic, syntactic foam, or aluminum. The solid cores may be covered with rubber to protect them from solvents and to enhance their sealing capabilities. Ball sealer diameters typically range from ⅝-in to 1¼ in, with specific gravities ranging from 0.8 to 1.9. With the exception of syntactic foam cores, most of the rubber-coated balls are designed to withstand hydrostatic pressures below 10,000 psi at temperatures below 200° F. Specific gravities of rubber-coated balls typically range from 0.9 to 1.4. Ball sealers with syntactic foam cores are capable of withstanding hydrostatic pressures up to 15,000 psi at temperatures up to 250° F., and have specific gravities ranging from 0.9 to 1.1.

These ball sealers will, however, begin to degrade when temperatures or pressures exceed the design limits. Degradation can also occur when exposing ball sealers to fluids like HCl, $CO_2$, or $H_2S$. Additionally, in the case of rubber coated ball sealers, the perforation can actually cut the rubber coating in the area of the pressure seal. Once the ball sealer loses its structural integrity, the unattached rubber is free to lodge permanently in the perforation which can reduce the flow capacity of the perforation and may permanently damage the well. The cut rubber coating will also result in exposure of the ball core material to the stimulation fluid, possibly resulting in dissolution of the core material. The capability of a ball sealer to block a perforation will diminish notably if degradation results in excessive ball deformation or in a breakdown of ball material. A ball sealer must remain essentially not deformed and intact under high pressures and temperatures to effectively block a perforation during a workover. Thus, material strength and environmental resistance are important aspects of ball sealer design.

Another important aspect of ball sealer design is density (or specific gravity). Past research and field studies indicate that the number of ball sealers that will seat onto perforations located inside a well (seating efficiency) depends on several factors, including the relative density of the ball sealer and the wellbore fluid. Erbstoesser [see *Journal of Petroleum Technology* (SPE Paper 8401), pp. 1903-1910 (1980)] observed that maximum seating efficiencies occurred when the ball density was 0.02 g/cc less than the workover fluid density which typically ranges from 0.8 g/cc to 1.3 g/cc. Thus, most workovers will require a low-density ball sealer in order to enhance seating efficiencies. Ball sealer density should also remain essentially constant to minimize changes between the relative density of the ball sealer and the wellbore fluid during a workover. There are various materials having high temperature and high pressure resistances. However, the problem with using these materials for a solid core ball sealer design is that these materials will typically have a high density as compared to common treating fluids. As a result, this higher density can prevent current commercial, solid core ball sealer designs made of high strength materials from seating against the perforations.

A potential problem with commercial ball sealers is quality control during ball manufacturing. The densities of ball sealers delivered for use during a workover will often vary notably from specified values. The lack of proper quality control when forming the solid core material, coupled with irregularities when applying the rubber coating, can cause variations in the overall ball density, and such variations can notably affect seating efficiencies during a workover. Current ball sealer designs do not allow for adjustments to be made to the ball sealer density prior to initiation of a workover. Thus, because of inventory costs, only a select range of ball sealer densities are typically available for immediate use. Further problems associated with current ball sealer designs include problems associated with retrieving the balls from the wellbore in order to resume production, jamming of equipment downhole due to excess balls remaining in and surrounding the production pipe, and plugging of surface production valves when remaining ball sealers are picked up by the motion of the production fluid and carried to the surface.

To summarize, deeper drilling has demanded stimulation jobs that are conducted under conditions that exceed the current temperature, pressure, and well-condition limitations of available low density ball sealers. Available low density ball sealers are typically not designed to withstand temperatures over 200° F.-250° F., hydrostatic pressures over 10,000-15,000 psi, or differential pressures over 1,500 psi. They are currently unable to perform effectively when exposed to hostile well environments because they deform excessively when exposed to the high temperatures and high bottomhole pressures often associated with deeper wells, particularly during long workovers or when exposed to solvents. Furthermore, those commercial ball sealers designed to withstand higher pressures or temperatures (e.g. ball sealers with rubber-covered, high strength, solid phenolic core) will have densities higher than the stimulation fluids used during the workover. Thus, the ball sealers will either not seat at all or seating efficiencies will decrease. The ability of commercial ball sealers to perform satisfactorily will decrease notably as temperatures begin to exceed 200° F. (93° C.). Ball sealer performance is limited further when hydrostatic pressures exceed 10,000 psi or when differential pressures across the perforations exceed 1,500 psi at high temperatures and pressures. These conditions are common during workovers in deep, hostile environment wells. For the foregoing reasons, a need exists for improved low density ball sealers which function properly in such hot, hostile environment wells, especially in the presence of acidic fluids.

Ball sealer designs began in about 1955 with Derrick, et al (U.S. Pat. No. 2,754,910). Therein, a method for plugging perforations using spherical and polygonal shaped solid and hollow cores made from materials (light metal alloys, thermoplastics, thermosets) with a soft, thin coating applied to the surface was suggested. Derrick did not, however, discuss or suggest using high strength materials (which are typically very dense) for a rigid, thick-walled, hollow core ball or using his ball sealers in high temperature (>200° F.), high pressure (>10,000 psi) applications. Further, Derrick's discussion was limited to subterranean applications at or below 10,000 psi.

In 1978, Erbstoesser (U.S. Pat. No. 4,102,401) first introduced the concept of using solid core syntactic foam balls, or glass micro-spheres mixed with epoxy. This material is a hard, lightweight material capable of withstanding high pressures. In U.S. Pat. No. 4,421,167, Erbstoesser suggested using ball sealers as diverting agents in perforated casings, wherein the ball sealers comprised polymethylpentane and a nonelastomeric plastic protective covering. Erbstoesser later advanced the idea of using a more durable, rubber-like material called polyurethane as a coating for syntactic foam balls in U.S. Pat. No. 4,407,368.

In U.S. Pat. No. 4,505,334, Doner, et al. suggested a method for making ball sealers by wrapping a thermostatic filament around a core, then curing the material. An elastomeric outer covering was described as being optional. In U.S. Pat. No. 4,702,316, Chung, et al., suggested a method for diverting steam in injection wells using ball sealers comprised of polymer compounds covered with a thin elastomer coating. The polymer compounds were described to include polystyrene, polymethyl groups and polydimethol groups.

In U.S. Pat. No. 5,253,709, Kendrick, et al. offered a solution to the problem generated by irregularly shaped wellbore perforations, involving a hard centered ball with a deformable outer shell capable of deforming to the irregular shape of the casing perforation. The inner core was described to be made of binders and wax, while the outer covering was a rubber. According to the specification, the ball sealer would eventually come loose from the casing perforation after a period of time following release of the stimulation pressure. However, no mention as to the solubility or degradability, if any, of the balls was made. Further, ball specific gravities ranged from 1.0 to 1.3, but no pressure or temperature ratings were provided.

Ball sealers comprised of a carbon-fiber reinforced polyetherketone polymer and having a density less than that of the treatment fluid were described by Gonzalez, et al. in U.S. Pat. No. 5,309,995. Such ball sealers are described as having a density in the range of 1.1 g/cc to 1.3 g/cc and suitable for use in downhole environments having a temperature in the range of 177-316° C. and a pressure in the range of 350-1758 $kg/cm^2$.

U.S. Pat. No. 5,485,882 to Bailey, et al. suggests rigid, hollow-core, low-density (0.8-1.3 g/cc) ball sealers suitable for use in cased wells at temperatures up to 400 F, hydrostatic pressures up to 20,000 psi, and differential pressures across the perforations up to 1,500 psi. The ball sealers are comprised of two pieces made of a high strength material, such as aluminum, and an optional high-strength thermoplastic rubber cover. Deformable ball sealers comprised of oxyzolidine, collagen and water and having a specific gravity in the range of 0.5 to 2.0, as well as methods for their manufacture, have been described in U.S. Pat. Nos. 5,990,051 and 6,380,138 to Ischy, et al.

In SPE 13085 ["*The Design of Buoyant Ball Sealer Treatments*", (1984)], Gabriel and Erbstoesser describe a methodology to maximize and optimize both the benefits which can be realized from and the composition of buoyant ball sealers having a density less than that of heavy treatment fluids but less than or equal to that of light treatment fluids. New water-soluble perforation ball sealers for use as diversion agents have been described in detail by Bilden, et al. [SPE Paper 49099, pp. 427-436 (1998)]. These water-soluble perforation ball sealers are composed primarily of injection-molded collagen, are stable in all hydrocarbon fluids, have a specific gravity from 1.11-1.25 g/cc, and are reported to be able to withstand perforation differential pressures from 500 to 3,000 psi.

All of these more recent ball sealer designs have resulted from an effort to develop a lower density ball that could withstand high temperatures and pressures or would seal more effectively. However, these recent designs have inherent problems including manufacturing and/or ingredient costs and limitations, density control issues, and performance limits, particularly with respect to hostile well environments.

Thus, there exists a need for an improved ball sealer having the ability to divert fluid flow from casing perforations of high permeability to perforations of low permeability, that is, capable of deformation to conform to the shapes of casing perforations, will retain its strength and form during a stimulation process, and that will degrade into products soluble in the fluids found in subterranean wellbores after the stimulation process is complete.

SUMMARY OF THE INVENTION

The present invention relates generally to a composition of matter and a method of manufacture used for degradable ball sealers to be used in the oil and gas industry, as well as methods of use of such compositions. In one aspect, the present invention comprises an injection molded ball sealer comprised of a mixture of ethylene and one or more alpha-olefins to form a solid, deformable, substantially spherical ball sealer having a density in the range of about 0.70 to about 1.5 g/cc that is soluble in production fluids such as oil or gas. Such ball sealers are particularly useful in wells having temperatures from about 100° F. (about 38° C.) to about 300° F. (about 149° C.), hydrostatic pressures ranging from about 10,000 psi to about 20,000 psi, and where differential pressures range from about 1,000 psi to about 3,000 psi.

In another aspect of the present invention, an injection molded ball sealer comprised of a mixture of ethylene, one or more alpha-olefins, and finely graded filler material to form a solid, deformable, substantially spherical ball sealer having a density in the range of about 0.70 to about 1.5 g/cc that is soluble in production fluids such as oil or gas is described. In accordance with this embodiment, the filler material is preferably uniformly mixed with the polymers prior to the injection molding operation.

In a further aspect, the present invention relates to methods for treating a subterranean formation surrounding a cased well having an interval provided with a plurality of perforations. Ball sealers of the present invention, suspended in a treatment fluid, are flowed down the casing to the perforated interval or intervals of the casing where treatment in the formation is not needed. The ball sealers, having a density less than the density of the treating fluid and a deformable composition, flow into and engage at least a portion of the perforations and are maintained in the perforations by the differential pressure between the treating fluid inside the wellbore and the fluid in the producing strata, thereby diverting fluid to unsealed portions of the perforated interval. Upon release of pressure, the ball sealers of the present invention disengage from the perforations and dissolve in the production fluids.

DESCRIPTION OF THE FIGURES

The following figures form part of the present specification and are included to further demonstrate certain aspects of the present invention. The invention may be better understood by reference to one or more of these figures in combination with the detailed description of specific embodiments presented herein.

Figure 1:
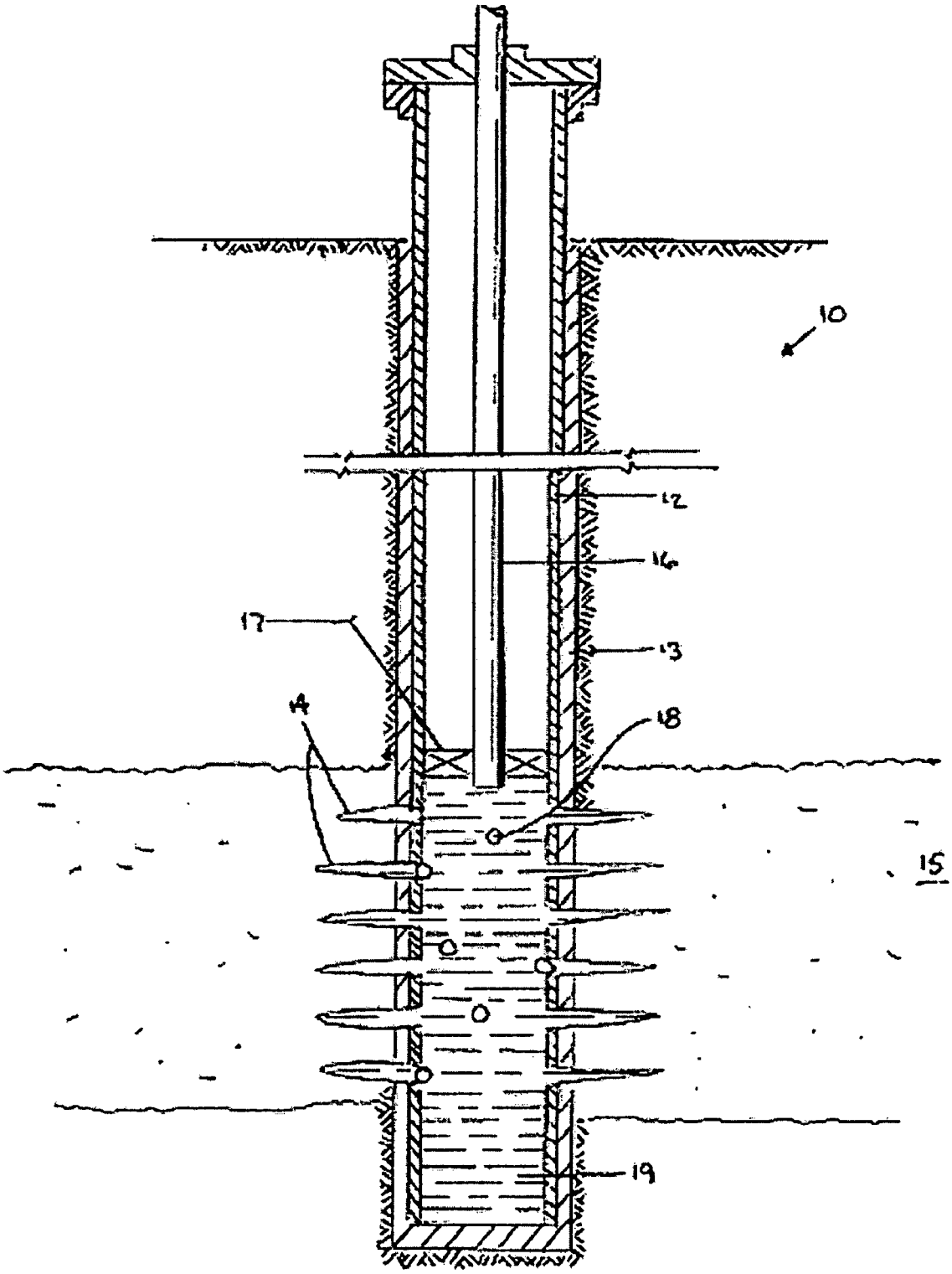
FIG. 1 is an elevation view in section of a well illustrating the practice of one embodiment of the present invention.

While the inventions disclosed herein are susceptible to various modifications and alternative forms, only a few specific embodiments have been shown by way of example in the drawings and are described in detail below. The figures and detailed descriptions of these specific embodiments are not intended to limit the breadth or scope of the inventive concepts or the appended claims in any manner. Rather, the figures and detailed written descriptions are provided to illustrate the inventive concepts to a person of ordinary skill in the art and to enable such person to make and use the inventive concepts.

DEFINITIONS

The following definitions are provided in order to aid those skilled in the art in understanding the detailed description of the present invention.

The term "carrier liquid" as used herein refers to oil or water based liquids that are capable of moving particles (e.g., proppants) that are in suspension. Low viscosity carrier fluid have less carrying capacity and the particles can be affected by gravity so that they either rise if they are less dense than the liquid or sink if they are more dense than the liquid. High viscosity liquids can carry particles with less settling or rising since the viscosity overcomes gravity effects.

In embodiments described and disclosed herein, the use of the term "introducing" includes pumping, injecting, pouring, releasing, displacing, spotting, circulating, or otherwise placing a fluid or material within a well, wellbore, or subterranean formation using any suitable manner known in the art. Similarly, as used herein, the terms "combining", "contacting", and "applying" include any known suitable methods for admixing, exposing, or otherwise causing two or more materials, compounds, or components to come together in a manner sufficient to cause at least partial reaction or other interaction to occur between the materials, compounds, or components.

The term "diverting agent", as used herein, means and refers generally to an agent that functions to prevent, either temporarily or permanently, the flow of a liquid into a particular location, usually located in a subterranean formation, wherein the agent serves to seal the location and thereby cause the liquid to "divert" to a different location.

The term "melt flow rate", or (MRF), as used herein, refers to a characteristic of a polymer or polymeric composition as determined in accordance with ISO 1133, condition 4, at a temperature of about 190° C. and a nominal load of 2,160 kg and is equivalent to the term "melt index". The melt flow rate, or (MRF), is indicated in g/10 min and is an indication of the flowability, and hence the processability, of the polymer or polymeric composition. The higher the melt flow rate, the lower the viscosity of the polymer.

The term "treatment", as used herein, refers to any of numerous operations on or within the downhole well, wellbore, or reservoir, including but not limited to a workover type of treatment, a stimulation type of treatment, such as a hydraulic fracturing treatment or an acid treatment, isolation treatments, control of reservoir fluid treatments, or other remedial types of treatments performed to improve the overall well operation and productivity.

The term "stimulation", as used herein, refers to productivity improvement or restoration operations on a well as a result of a hydraulic fracturing, acid fracturing, matrix acidizing, sand treatment, or other type of treatment intended to increase and/or maximize the well's production rate or its longevity, often by creating highly conductive reservoir flow paths.

The term "soluble," as used herein, means capable of being melted or dissolved upon exposure to a solvent such as wellbore fluids at subterranean formation conditions. The typical solvent includes any polar or nonpolar solvent, such as water, diesel or kerosene oil. Other examples include acidified water such as 10 to 20 percent hydrochloric acid, ammonium chloride at 2.5 percent, or potassium chloride at 2.5 percent. The geometry of the material may also be a factor for how soluble a material is—those items with increased surface area will have a greater solubility than those items with decreased surface area.

A material will be more soluble at high pressure and at high temperature than at low pressure or at low temperature. Soluble materials include those materials that are soluble in water or hydrocarbons. A material can be considered soluble if it completely dissolves in temperatures of 175° F. to 200° F. at atmospheric pressure in 2 hours. At a pressure of 1000 psi, a material can be considered soluble if it completely dissolves in 1 hour and 10 minutes. At about 90° F., a material can be considered soluble if it completely dissolves in about 36 hours. The estimate of complete dissolution can be based on visual observation or on filtering the surrounding solution to collect solids and then estimating the mass of material that is dissolved.

The term "deformable," as used herein, means capable of being deformed or put out of shape. For example, a ball may be deformed when its shape is no longer spherical, such as when it deforms to assume the shape of a perforation. It is an indication that the ball shape is flexible.

The term "degrade," as used herein, means to lower in character or quality; to debase. For example, a ball sealer may be said to have degraded when it has undergone a chemical breakdown. Methods of degradation can include hydrolysis, solventolysis, or complete dissolution.

The term "substantially plugging," as used herein, means to plug a perforation. The perforation can be considered substantially plugged if it is at least 95 percent plugged. This can be estimated in a lab environment by measuring the size of an indentation and the size of a diameter of perforation. Also, visual tests in a lab environment can be used to estimate that no fluid flows into a perforation.

DETAILED DESCRIPTION OF THE INVENTION

One or more illustrative embodiments incorporating the invention disclosed herein are presented below. Not all features of an actual implementation are described or shown in this application for the sake of clarity. It is understood that in the development of an actual embodiment incorporating the present invention, numerous implementation-specific decisions must be made to achieve the developer's goals, such as compliance with system-related, business-related, government-related and other constraints, which vary by implementation and from time to time. While a developer's efforts might be complex and time-consuming, such efforts would be, nevertheless, a routine undertaking for those of ordinary skill the art having benefit of this disclosure.

In embodiments of the disclosed diverting agent, single and multiple intervals of a subterranean formation can be treated or stimulated in stages by successively introducing the ball sealer diverting agent of the present invention comprising a polymer of ethylene and one or more alpha-olefins and having a density of about 0.7 g/cc to about 1.5 g/cc. Optionally, and in accordance with the present invention, the addition of finely graded filler material to the polymeric mixture can be included so as to change the density and/or specific gravity of the ball sealer to be in a range from about 0.7 g/cc to about 1.5 g/cc.

The invention provides production fluid (e.g., oil) soluble, deformable ball sealer compositions comprising ethylene and one or more alpha-olefins, as well as processes for preparing such compositions and methods of use as diverting agents. These compositions are useful in subterranean formations for diverting well treatment fluids in a single interval to increase the fracture length or in multiple intervals of a subterranean formation having varying permeability and/or injectivity during a hydraulic fracturing operation. In using the ball sealers of the present invention in fracturing processes, the ball sealer acts to divert the fracture by seating itself in the perforations in the wellbore casing and deflecting the treating fluid to unsealed portions of the perforated interval.

While compositions and methods are described in terms of "comprising" various components or steps, the compositions and methods can also "consist essentially of" or "consist of" the various components and steps.

Unless otherwise indicated, all numbers expressing quantities of ingredients, properties such as molecular weight, reaction conditions, and so forth used in the present specification and associated claims are to be understood as being modified in all instances by the term "about". Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claim, each numerical parameter should at least be construed in light of the number of reported significant digits and by applying ordinary rounding techniques.

Composition

The deformable ball sealers of the present invention comprise unimodal or multimodal polymeric mixtures of ethylene or other suitable, linear or linear, branched alkene plastics, such as isoprene, propylene, and the like, although ethylene is typically employed in the compositions described herein. Such ethylene polymeric mixtures typically comprise ethylene and one or more co-monomers selected from the group consisting of alpha-olefins having up to 12 carbon atoms, which in the case of ethylene polymeric mixtures means that the co-monomer or co-monomers are chosen from alpha-olefins having from 3 to 12 carbon atoms (i.e., $C_3$-$C_{12}$), including those alpha-olefins having 3 carbon atoms, 4 carbon atoms, 5 carbon atoms, 6 carbon atoms, 7 carbon atoms, 8 carbon atoms, 9 carbon atoms, 10 carbon atoms, 11, carbon atoms, or 12 carbon atoms. Alpha-olefins suitable for use as co-monomers with ethylene in accordance with the present invention can be substituted or un-substituted linear, cyclic or branched α-olefins. Preferred co-monomers suitable for use with the present invention include but are not limited to 1-propene, 1-butene, 4-methyl-1-pentene, 1-pentene, 1-hexene, 1-octene, 1-decene, 1-dodecene, and styrene.

Typical ethylene polymeric mixtures which comprise the ball sealers of the present invention include ethylene-octene polymeric mixtures, ethylene-butene mixtures, ethylene-styrene mixtures, and ethylene-pentene mixtures. More typically, the deformable ball sealers of the present invention comprise ethylene-octene, ethylene-butene, and ethylene-pentene polymeric mixtures. A particular ethylene-octene copolymer component of the deformable ball sealer composition of the present invention is a substantially linear elastic olefin polymer, such as those described in U.S. Pat. No. 5,278,272 (Lai, et al.) or one of a variety of saturated ethylene-octene copolymers manufactured and sold by The Dow Chemical Company (Midland, Mich.) under the brand name ENGAGE™. Examples of suitable ethylene-octene copolymers suitable for use with the present invention include ENGAGE™ 8402 and ENGAGE™ 8407. Similarly, a particular ethylene-butene copolymer component of the deformable ball sealer composition described herein can be one of a variety of saturated ethylene-butene polyolefin elastomer copolymers manufactured and sold by Dow Chemical Company (Midland, Mich.) under the brand name ENGAGE™, including for example ENGAGE™ 7467, as well as blends of such elastomers, and compositions comprising blends of these elastomers.

In accordance with one aspect of the present invention, the ethylene-α-olefin polymeric mixtures suitable for use in forming deformable ball sealers in accordance with the present disclosure have preferred ranges of one or more of the following properties—density, Melt Flow Index (MFI), Ultimate Tensile elongation, Shore A Hardness, and glass transition temperature. Typically, these polymeric mixtures can have densities (according to ASTM Test Method D-792) from about 0.800 g/cm$^3$ to about 0.950 g/cm$^3$; MFI values (according to ASTM Test Method D-1238) from about 1.0 to about 35, as well as values between these ranges (e.g., 30); Ultimate Tensile elongation (according to ASTM D-638) from about 400% to about 950%; Shore A Hardness (according to ASTM D-2240) from about 55 to about 90; and/or glass transition temperatures, $T_g$, from about −60° C. to about −30° C.

The ethylene-α-olefin polymers useful herein may include linear copolymers, branched copolymers, block copolymers, A-B-A triblock copolymers, A-B diblock copolymers, A-B-A-B-A-B multiblock copolymers, and radial block copolymers, and grafted versions thereof, as well as homopolymers, copolymers, and terpolymers of ethylene and one or more alpha-olefins. Examples of useful compatible polymers include block copolymers having the general configuration A-B-A, having styrene endblocks and ethylene-butadiene or ethylene-butene midblocks, some of which are available under the tradename of KRATON™ G commercially available from Shell Chemical Co. (Houston, Tex.), as well as other various grades of KRATON™ G commercially available for use, including KRATON™ G-1726, KRATON™ G-1657, KRATON™ G-1652, and KRATON™ G-1650 (saturated A-B diblock/A-B-A triblock mixtures with ethylene-butadiene midblocks); KRATON™ D-1112, a high percent A-B diblock linear styrene-isoprene-styrene polymer; KRATON™ D-1107 and KRATON™ D-1111, primarily A-B-A triblock linear styrene-isoprene-styrene polymers; STEREON™ 840A and STEREON™ 841A, an A-B-A-B-A-B multiblock styrene-butadiene-styrene polymer available from Firestone (Akron, Ohio); EUROPRENE™ Sol T 193B, a linear styrene-isoprene-styrene polymer available from Enichem Elastomers (New York, N.Y.); EUROPRENE™ Sol T 163, a radial styrene-butadiene-styrene polymer also available from Enichem Elastomers; VECTOR™ 4461-D, a linear styrene-butadiene-styrene polymer available from Exxon Chemical Co. (Houston, Tex.); VECTOR™ 4111, 4211, and 4411, fully coupled linear styrene-isoprene-styrene polymers containing different weight percentages of styrene endblock; and VECTOR™ 4113, a highly coupled linear styrene-isoprene-styrene polymer also available from Exxon Chemical Co.

Other polymers, such as homopolymers, copolymers and terpolymers of ethylene and one or more alpha-olefins are also useful as compatible polymers in forming the ball sealers of the present invention. Some examples include ethylene vinyl acetate copolymers such as ELVAX™ 410 and ELVAX™ 210 available from DuPont Chemical Co. located in Wilmington, Del.; ESCORENE™ UL 7505 available from Exxon Chemical Co.; ULTRATHENE™ UE 64904 available from Quantum Chemical Corp. (Rolling Meadows, Ill.); and AT 1850M available from AT Polymers & Film Co. (Charlotte, N.C.). Other useful polymers include EXACT™ 5008, an ethylene-butene polymer; EXXPOL™ SLP-0394, an ethylene-propylene polymer; EXACT™ 3031, an ethylene-hexene polymer all available from Exxon Chemical Co.; and INSIGHT™ SM-8400, an ethylene-octene polymer available from Dow Chemical Co. located in Midland, Mich.

In accordance with the present invention, and in order to optimize the properties of the deformable ball sealer of the present invention, the individual monomers or copolymers in the olefin polymer mixture should be present in such a weight ratio that the desired properties of the final product are achieved by combination of the individual monomers, co-monomers, or polymers. Consequently, the individual components of the polymeric mixture comprising the ball sealer should not be present in such small amounts, such as about 10% by weight or below, that they do not affect the properties of the ethylene-alpha-olefin polymeric mixture. To be more specific, it is typical that the amount of alpha-olefin in the polymeric mixture makes up at least about 1% by weight but no more than about 60% by weight of the total composition, and the amount of ethylene in the polymeric mixture makes up from about 20% by weight to about 90 wt. % of the total composition, thereby optimizing the deformability, density, and thermostability properties of the end product ball sealer. More specifically, the amount of alpha-olefin in the polymeric compositions of the present invention include, for example, about 1 wt. %, about 2 wt. %, about 3 wt. %, about 4 wt. %, about 5 wt. %, about 6 wt. %, about 7 wt. %, about 8 wt. %, about 9 wt. %, about 10 wt. %, about 15 wt. %, about 20 wt.

%, about 25 wt. %, about 30 wt. %, about 35 wt. %, about 40 wt. %, about 45 wt. %, about 50 wt. %, about 55 wt. %, and about 60 wt. %, as well as amounts between any two of these values, e.g., from about 1 wt. % to about 25 wt. %. Similarly, the amount of ethylene (or similar linear alkene) in the polymeric compositions of the present invention includes, for example, about 20 wt. %, about 25 wt. %, about 30 wt. %, about 35 wt. %, about 40 wt. %, about 45 wt. %, about 50 wt. %, about 55 wt. %, about 60 wt. %, about 65 wt. %, about 70 wt. %, about 75 wt. %, about 80 wt. %, about 85 wt. %, and about 90 wt. %, as well as amounts between any two of these values, e.g., from about 25 wt. % to about 80 wt. %. For example, typical compositions in accordance with the present disclosure could comprise about 50 wt. % ethylene and about 50 wt. % octene or 50 wt. % butene, or, alternatively, about 70 wt. % ethylene and about 25 to about 30 wt. % octene. Other typical copolymeric blend compositions in accordance with the present composition can comprise from about 80 to about 85 wt. % ethylene and from about 15 to about 20 wt. % butene or pentene.

The properties of the individual polymers in the ethylene-α-olefin polymer mixture comprising the deformable ball sealer according to the present invention should typically be so chosen that the final ball sealer product has a density from about 0.70 g/cc (g/cm$^3$) to about 1.5 g/cc, such as from about 0.80 g/cc to about 1.00 g/cc, and such as from about 0.84 g/cc to about 0.86 g/cc. Ball sealer densities which can be formulated and used in accordance with the present invention include, for example, about 0.70 g/cc, about 0.75 g/cc, about 0.80 g/cc, about 0.85 g/cc, about 0.90 g/cc, about 0.95 g/cc, about 1.00 g/cc, about 1.10 g/cc, about 1.20 g/cc, about 1.30 g/cc, about 1.40 g/cc, and about 1.50 g/cc, as well as densities and density ranges between any two of these values, e.g., a density from about 0.80 g/cc to about 1.10 g/cc, or a density of about 1.05 g/cc. Additionally, the ethylene-α-olefin polymeric mixture used in forming the deformable ball sealer of the present invention has a melt flow rate (MRF) from about 0.1 g/10 min to about 3.0 g/10 min, typically from about 0.2 g/10 min to about 2.0 g/10 min. According to the invention, this can be achieved by the olefin polymer mixture comprising ethylene having a first density and flow rate and at least an alpha-olefin monomer, co-monomer, copolymer, etc. having a second density and flow rate such that the final ethylene-α-olefin polymeric mixture obtains the density and the melt flow rate (MRF) in the ball sealer product indicated above.

In a further embodiment of the present invention, the specific properties of the deformable ball sealers as described herein can be further controlled by the addition of one or more finely graded filler materials to the ethylene-α-olefin polymer mixture. The addition of such filler materials advantageously allows the density of the ball sealer product to be expanded as required by the circumstances and/or specific needs of the user. In accordance with this aspect of the invention, the properties of the ethylene-α-olefin polymer mixture in combination with one or more finely graded filler materials provides a deformable ball sealer having a density from about 0.70 g/cc (g/cm$^3$) to about 1.5 g/cc, such as from about 0.80 g/cc to about 1.00 g/cc, and such as from about 0.84 g/cc to about 0.86 g/cc. Ball sealer densities which can be formulated and used in accordance with the present invention include, for example, about 0.70 g/cc, about 0.75 g/cc, about 0.80 g/cc, about 0.85 g/cc, about 0.90 g/cc, about 0.95 g/cc, about 1.00 g/cc, about 1.10 g/cc, about 1.20 g/cc, about 1.30 g/cc, about 1.40 g/cc, and about 1.50 g/cc, as well as densities and density ranges between any two of these values, e.g., a density from about 0.80 g/cc to about 1.10 g/cc, or a density of about 1.05 g/cc. Examples of the properties of a deformable ball sealer of the invention having a filler material added to the polymeric mixture prior to injection molding is shown in Examples 2 and 3 herein. As can be seen, the addition of about 30 weight percent (wt. %) silica sand (100 mesh) or silica flour in combination with about 70 wt. % ethylene-α-olefin polymer mixture allows for a deformable ball sealer with a specific gravity of about 1.4 g/cc to be obtained.

Finely graded filler materials, in accordance with the present disclosure, refers to a broad range of finely powdered materials that are substantially non-reactive in a downhole, subterranean environment, and typically have a size from about 150 mesh to about 350 mesh, and more typically from about 200 mesh to about 325 mesh. In accordance with the present invention, examples of suitable filler materials include, but are not limited to, natural organic materials, silica materials and powders, ceramic materials, metallic materials and powders, synthetic organic materials and powders, mixtures thereof, and the like. Typical examples of such finely graded filler materials suitable for use herein include but are not limited to silica flour (such as 325 mesh Silica Flour available from Santrol, Fresno, Tex.), calcium carbonate fillers (such as that available in a variety of mesh sizes from Vulcan Minerals Inc., Newfoundland, Calif.), and fumed silica (such as that available from PT Hutchins Co., Ltd., Los Angeles, Calif.).

Natural organic materials suitable for use as filler materials include, but are not limited to, finely ground nut shells such as walnut, brazil nut, and macadamia nut, as well as finely ground fruit pits such as peach pits, apricot pits, or olive pits, and any resin impregnated or resin coated version of these.

Silica materials and powders suitable for use as filler materials with the present invention include, but are not limited to, glass spheres and glass microspheres, glass beads, glass fibers, silica quartz sand, sintered Bauxite, silica flour, silica fibers, and sands of all types such as white or brown, silicate minerals, and combinations thereof. Typical silica sands suitable for use include Northern White Sands (Fairmount Minerals, Chardon, Ohio), Ottawa, Jordan, Brady, Hickory, Arizona, St. Peter, Wonowoc, and Chalfort. In the case of silica or glass fibers being used, the fibers can be straight, curved, crimped, or spiral shaped, and can be of any grade, such as E-grade, S-grade, and AR-grade. Typical silicate minerals suitable for use herein include the clay minerals of the Kaolinite group (kaolinite, dickite, and nacrite), the Montmorillonite/smectite group (including pyrophyllite, talc, vermiculite, sauconite, saponite, nontronite, and montmorillonite), and the Illite (or clay-mica) group (including muscovite and illite), as well as combinations of such clay minerals.

Ceramic materials suitable for use with the methods of the present invention include, but are not limited to, ceramic beads; clay powders; finely crushed spent fluid-cracking catalysts (FCC) such as those described in U.S. Pat. No. 6,372,378; finely crushed ultra lightweight porous ceramics; finely crushed economy lightweight ceramics; finely crushed lightweight ceramics; finely crushed intermediate strength ceramics; finely crushed high strength ceramics such as crushed "CARBOHSP™" and crushed "Sintered Bauxite" (Carbo Ceramics, Inc., Irving, Tex.), and finely crushed HYPERPROP G2™, DYNAPROP G2™, or OPTIPROP G2™ encapsulated, curable ceramic proppants (available from Santrol, Fresno, Tex.).

Metallic materials and powders suitable for use with the embodiments of the present invention include, but are not limited to, aluminum shot, aluminum pellets, aluminum needles, aluminum wire, iron shot, steel shot, iron dust (powdered iron), transition metal powders, transition metal dust, and the like.

Synthetic organic materials and powders are also suitable for use as filler materials with the present invention. Examples of suitable synthetic materials and powders include, but are not limited to, plastic particles, beads or powders, nylon beads, nylon fibers, nylon pellets, nylon powder, SDVB (styrene divinyl benzene) beads, SDVB fibers, TEFLON® fibers, carbon fibers such as PANEX™ carbon fibers from Zoltek Corporation (Van Nuys, Calif.) and KYNOL™ carbon fibers from American Kynol, Inc. (Pleasantville, N.Y.), KYNOL™ novoloid "S-type" fillers, fibers, and yarns from American Kynol Inc. (Pleasantville, N.Y.), and carbon powders/carbon dust (e.g., carbon black).

The deformable ball sealer as described above is capable of sealing perforations inside cased wells at temperature from about 100° F. (38° C.) to about 300° F. (149° C.), more preferably from about 100° F. (38° C.) to about 250° F. (121° C.), and most preferably from about 150° F. (65.5° C.) to about 225° F. (107° C.), including temperatures between such ranges, e.g., about 200° F. (93° C.). Similarly, the deformable ball sealers of the present invention can operate at differential pressures up to about 3,000 psi, including from about 1,000 psi to about 3,000 psi, and more preferably from about 1,000 psi to about 2,000 psi. The ball sealers in accordance with the present invention are capable of sealing perforations inside cased wells at hydrostatic pressures up from about 8,000 psi to about 13,000 psi.

The ball sealer compositions, as described herein, are degradable following completion of their use in sealing perforations inside cased wells. By degradable, it is meant that the ball sealer compositions as described herein break-down after a period of time and dissolve in wellbore fluids, thereby minimizing and/or eliminating problems with further wellbore stimulations, further use of aqueous wellbore treatment fluids, and well stimulation equipment. These deformable and degradable ball sealers, according to the present invention, are soluble in, for example, hydrocarbon fluids, under both acidic and neutral pH environments. Suitable hydrocarbon fluids which the ball sealers of the present invention are soluble in include diesel, kerosene, and mixtures thereof. By "acidic pH", it is meant that the environment surrounding the ball sealers (e.g., the treating fluid) has a pH less than about 7, while by "neutral pH" it is meant that the environment surround the ball sealers has a pH of about 7.

Method of Making

The polymeric, deformable ball sealers of the present invention can be manufactured using a number of processes, including injection molding and the like. Such processes allow the polymeric, deformable ball sealers to have any number of desired three-dimensional geometric shapes, including polygonal and spherical. Preferably, the deformable ball sealers of the present invention are substantially spherical in shape. However, it will be apparent to those of skill in the art that any of the commonly used shapes for use in oil field tubular pipes can be used in accordance with the present invention. Further, and in accordance herein, finely graded filler material can be added before injection molding, and the filler material and polymeric mixture blended together uniformly so as to obtained the final product with the desired specific gravity of the soluble ball sealer.

The process of the invention is practiced in a conventional injection molding machine. The thermoplastic resin/polymer mixture in particulate form is tumble blended with the masterbatch until homogeneous. The blend is charged to the hopper of an injection molding machine which melts the resin under heat and pressure converting it to a flowable thermoplastic mass. Typically, when an ethylene alpha-olefin copolymer is used, the feed temperature is at about 200° F. to about 300° F., and the extruder barrel is at a temperature of about 230° F. to about 290° F. and a nozzle temperature of about 240° F. to about 290° F.

The nozzle of the injection molding machine is in liquid flow communication with a mold whose mold cavity or cavities is of substantially the same dimension as the final core. The molds are water cooled to a temperature of about 32° F. to about 65° F. and preferably to a temperature of about 35° F. to about 45° F. which is necessary to form a skin on the surface of the polymeric mass injected into the mold. Upon injection of the required amount of polymeric mixture in optional combination with one or more filler materials (referred to alternatively herein as "thermoplastic material") into the mold cavity, the mold is continuously cooled with water in order to maintain the mold cavity surface at the low temperature. The thermoplastic mass is held in the mold for a period of time of about 4 to about 6 minutes and more preferably, from about 4½ to about 5 minutes in order that the thermoplastic mass form a spherical mass of adequate strength so that upon removal of the spherical mass from the mold, the mass does not collapse. The upper limit of residence time within the mold is a matter of economics since the thermoplastic mass may be held within the mold for an indefinite period of time. However, since production speed and re-use of the mold is desirable, economic residence duration is defined as the upper limit. Upon removal of the mass from the mold, the sprue is cut with a small excess above the surface of the sphere to allow for shrinkage, and the formed ball core is placed in a water immersion bath at about 32° F. to about 65° F., and more preferably, at about 35° F. to about 45° F., for a period of time to substantially quench the ball. The minimum period of quenching time in the water bath is about 15 minutes. If the ball is not sufficiently cooled in the water bath, it does not shrink and an oversize product is obtained. After removal from the water bath, the balls are placed on a rack at ambient temperature.

Ball sealers in accordance with the present invention that are formed from the above process have dimensions substantially the same as the mold cavity, and such cores can be produced within tolerances of plus or minus 0.1% deviation in circumference and plus or minus 0.6% deviation in weight. The ball is typically characterized by a substantially smooth surface and a substantially spherical shape, although other polygonal shapes can be used. Further, and in accordance with the present invention, the ball sealers can be manufactured in any desired diameter/size, although the preferred diameters are about ⅝" (about 1.58 cm) and about ⅞" (about 2.22 cm) in diameter. For example, and in accordance with the present invention, substantially spherical ball sealers can have a diameter from about 0.2 inches (about 0.51 cm) to about 5.0 inches (about 12.7 cm), and more preferably from about 0.5 inches (about 1.27 cm) to about 2.0 inches (about 5.1 cm). As indicated above, while substantially spherical shapes have been specifically described, it will be apparent that other shapes consistent with oilfield operations and downhole geometry could be made and used in accordance with the present invention, including but not limited to polyhedrons (solids bounded by a finite number of plane faces, each of which is a polygon) such as "regular polyhedrons (tetrahedrons, hexahedrons, octahedrons, decahedrons, dodecahedrons, and icosahedrons), as well as non-regular polyhedra such as those polyhedrons consisting of two or more regular polyhedrons (e.g., 2 regular tetrahedrons), and semi-regular polyhedrons (those that are convex and all faces are regular polyhedrons), as well as well-known polyhedra such as pyramids.

Method of Using

Utilization of the present invention according to a preferred embodiment is generally depicted in FIG. 1. The well 10 of FIG. 1 has a casing 12 extending for at least a portion of its length and is cemented around the outside to hold the casing 12 in place and isolate the penetrated formation or intervals. The cement sheath 13 extends upward from the bottom of the wellbore in the annulus between the outside of the casing 12 and the inside wall of the wellbore at least to a point above producing strata 15. For the hydrocarbons in the producing strata 15 to be produced, it is necessary to establish fluid communication between the producing strata 15 and the interior of the casing 12. This is accomplished by perforations 14 made through the casing 12 and the cement sheath 13 by means known to those of ordinary skill, such as be a perforating gun and the like. The perforations 14 form a flow path for fluid from the formation into the casing 12 and vice versa.

The hydrocarbons flowing out of the producing strata 15 through the perforations 14 and into the interior of the casing 12 may be transported to the surface through a production tubing 16. An optional production packer 17 can be installed near the lower end of the production tubing 16 and above the highest perforation 14 to achieve a pressure seal between the production tubing 16 and the casing 12, if necessary. Production tubings 16 are not always used and, in those cases, the entire interior volume of the casing 12 is used to conduct the hydrocarbons to the surface of the earth.

Figure 2:
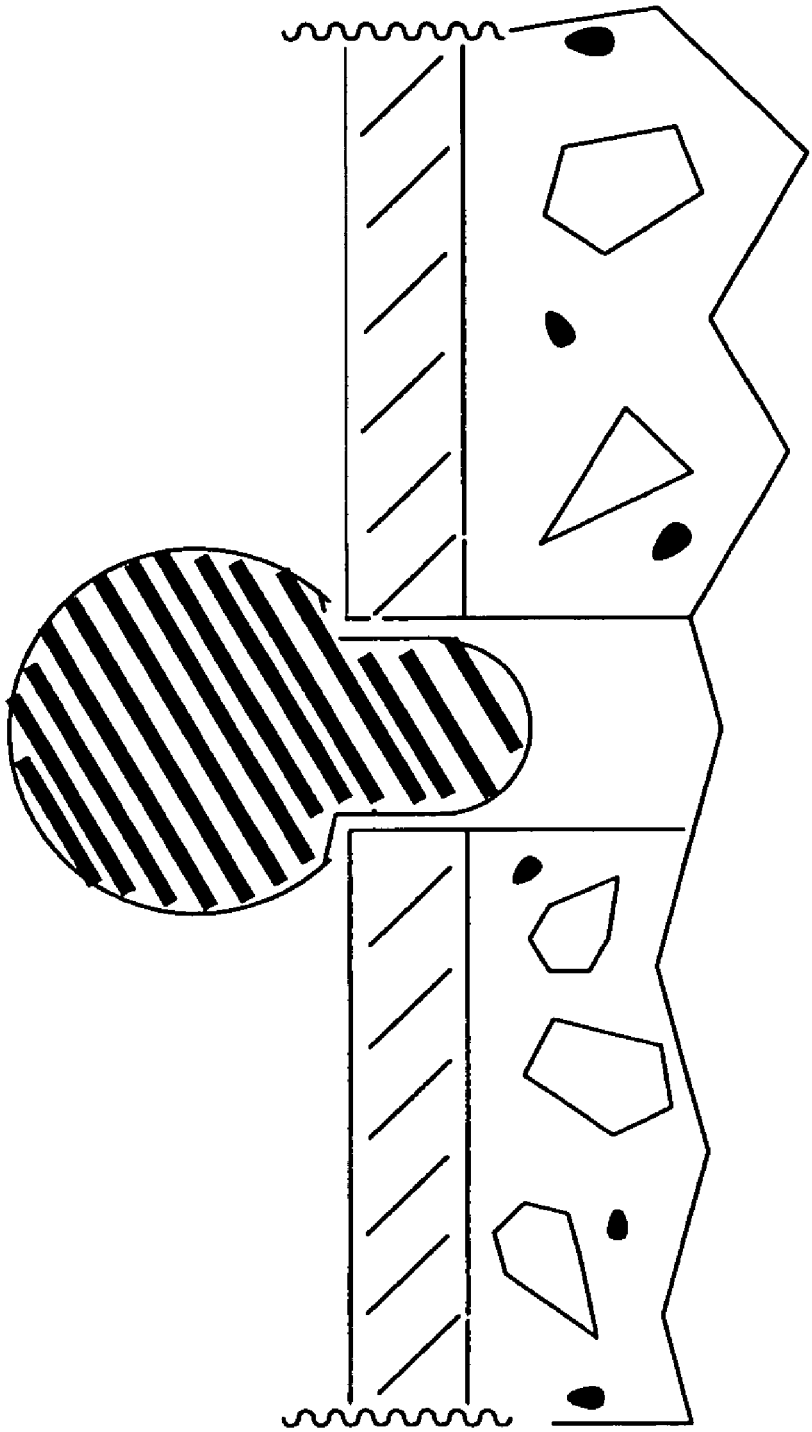
FIG. 2 shows a cross-sectional view of a ball sealer in accordance with the present invention engaging a casing perforation.

When diversion is needed during a well treatment, ball sealers 18 in accordance with the present invention are used to substantially seal some of the perforations. Substantial sealing occurs when flow through a perforation 14 is significantly reduced as indicated by an increase in wellbore pressure as a ball sealer 18 blocks off a perforation 14. As indicated previously herein, these ball sealers 18 are preferred to be substantially spherical in shape, but other geometries can be used. Using ball sealers 18 to plug some of the perforations 14 is accomplished by introducing the ball sealers 18 into the casing 12 at a predetermined time during the treatment. When the ball sealers 18 are introduced into the fluid upstream of the perforated parts of the casing 12, they are carried down the production tubing 16 or casing 12 by the treating fluid 19 flow. Once the treating fluid 19 arrives at the perforated interval in the casing, it flows outwardly through the perforations 14 and into the strata 15 being treated, as indicated by the arrows. The flow of the treating fluid 19 through the perforations 14 carries the ball sealers 18 toward the perforations 14 causing them to seat on the perforations 14. Once seated on the perforations 14, ball sealers 18 are held onto the perforations 14 by the fluid pressure differential which exists between the inside of the casing 12 and the producing strata 15 on the outside of the casing 12. The ball sealers 18 are preferably sized to substantially seal the perforations, when seated thereon. The seated ball sealers 18 serve to effectively close those perforations 14 until such time as the pressure differential is reversed, and the ball sealers 18 are released. See FIG. 2 for an enlarged cross-sectional view of a ball sealer in accordance with the present invention engaging a casing perforation.

With reference to FIG. 1, the ball sealers 18 will tend to first seal the perforations 14 through which the treating fluid 19 is flowing most rapidly. The preferential closing of the high flow rate perforations 14 tends to equalize treatment of the producing strata 15 over the entire perforated interval. For maximum effectiveness in seating on perforations 14, the ball sealers 18 preferably should have a density less than the density of the treating fluid 19 in the wellbore at the temperature and pressure conditions encountered in the perforated area downhole. If a ball sealer 18 is not sufficiently strong to withstand these temperatures and pressures, it will collapse, causing the density of the ball sealer 18 to increase to a density which can easily exceed the treating fluid density. Under such conditions, the ball sealers 18 may not seat at all or seating efficiency will decrease and thus performance will decline. Another possibility is that once seated, the ball sealers 18 may begin extruding into the perforations 14 and then block or permanently seal them, thus detrimentally affecting well production following completion of the workover. The number of ball sealers needed during a workover depends on the objectives of the stimulation treatment and can be determined by one skilled in the art.

The various embodiments of the inventive ball sealer described herein are highly suitable for use in most wells (shallower than 15,000 ft.) where bottom hole hydrostatic pressures during stimulation will generally be in the range of about 8,000 to about 13,000 psi and temperatures in the range of about 100° F. (38° C.) to about 350° F. (177° C.). Also, the pressure differential across each of the perforations ranges from about 1,000 psi to about 3,000 psi, with a preferential operation differential pressure from about 1,000 psi to about 2,000 psi. It may also be preferable to use the inventive ball sealers when the temperatures are in the range of about 200° F. to about 300° F. with hydrostatic pressures exceeding 10,000 psi and differential pressures exceeding 1,500 psi, especially when the stimulation treatment requires a low and/or variable density ball sealer.

Generally, the invention is a low-density ball sealer that can withstand the degradation effects of solvents common to oil and gas wells during a workover. It is also designed to resist changes in density during at least about a 24-hour period, although it is believed that longer periods of time could be endured. As mentioned previously, densities of the ball sealers of the present invention can range from about 0.70 g/cc to about 1.5 g/cc by varying the size (diameter) or the polymeric composition. Optionally, the densities of the ball sealers of the present invention can range from about 0.70 g/cc to about 1.5 g/cc by varying the size (diameter), polymeric composition, and the amount and type of finely graded filler material added to the polymeric composition. An optional coating can be applied to protect the polymeric material, if necessary (e.g., to protect the ball sealer when exposed to HCl and similar harsh components during a workover).

Figure 3:
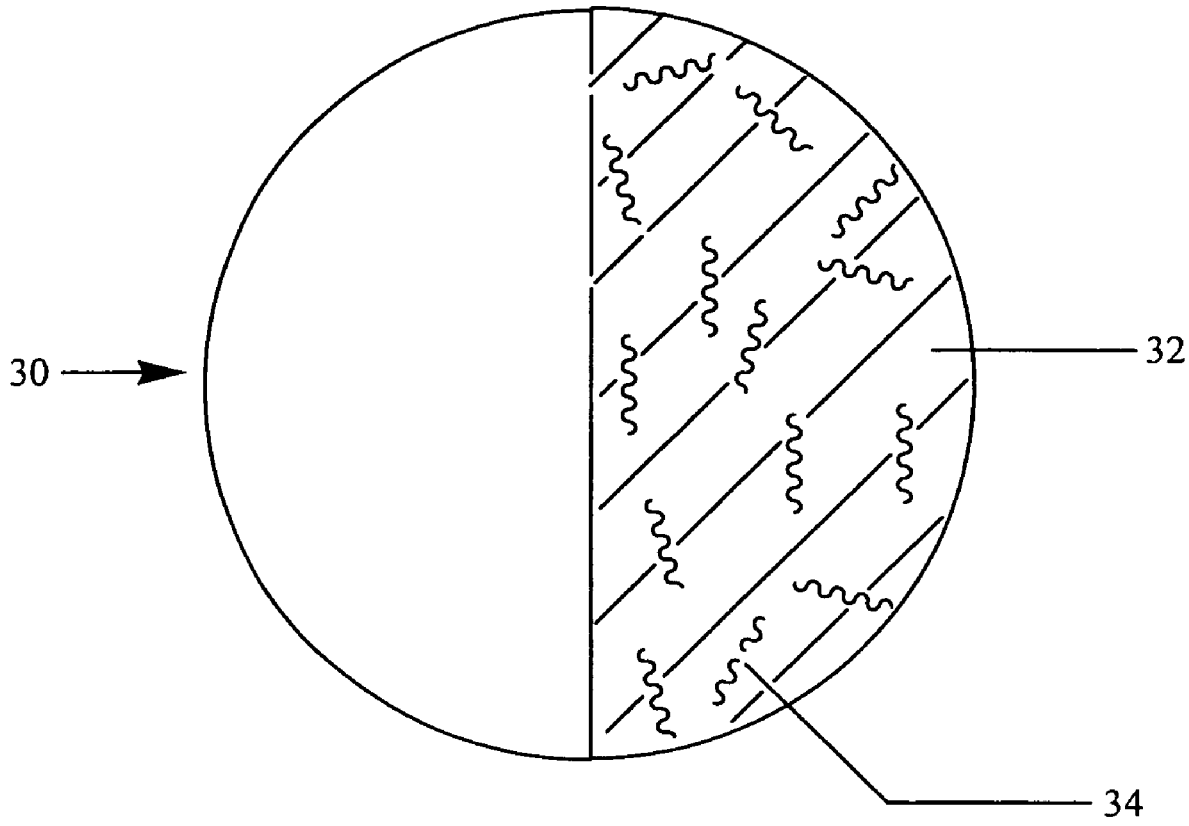
FIG. 3 is a partially cut away cross-sectional view of a ball sealer in accordance with one aspect of the present invention, the ball sealer being substantially solid.

One aspect of the ball sealer composition of the present invention is shown in FIG. 3, showing a partial cut-away of ball sealer 30. Ball sealer 30, in this aspect, is substantially spherical and substantially solid, the sealer 30 itself being comprised of polymeric material 32 comprised of ethylene and one or more alpha-olefins. Polymeric material 32 further contains filler material 34, such as silica sand or flour, or metal powder, in order to obtain the desired density/specific gravity of the ball sealer.

Figure 4:
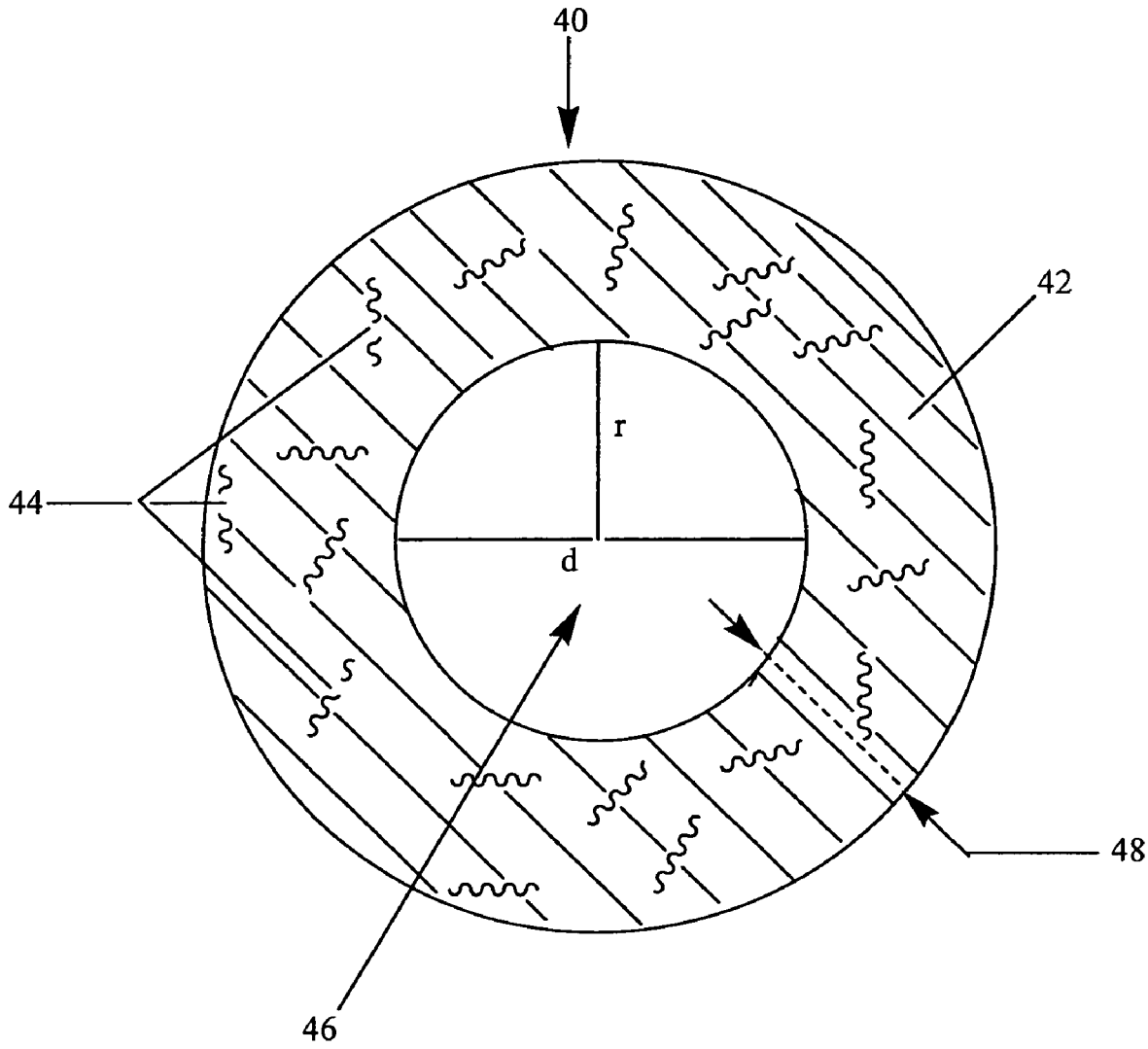
FIG. 4 is a cross sectional view through the center of another aspect of the ball sealer of the present invention, the ball sealer having a hollow core.
Figure 5:
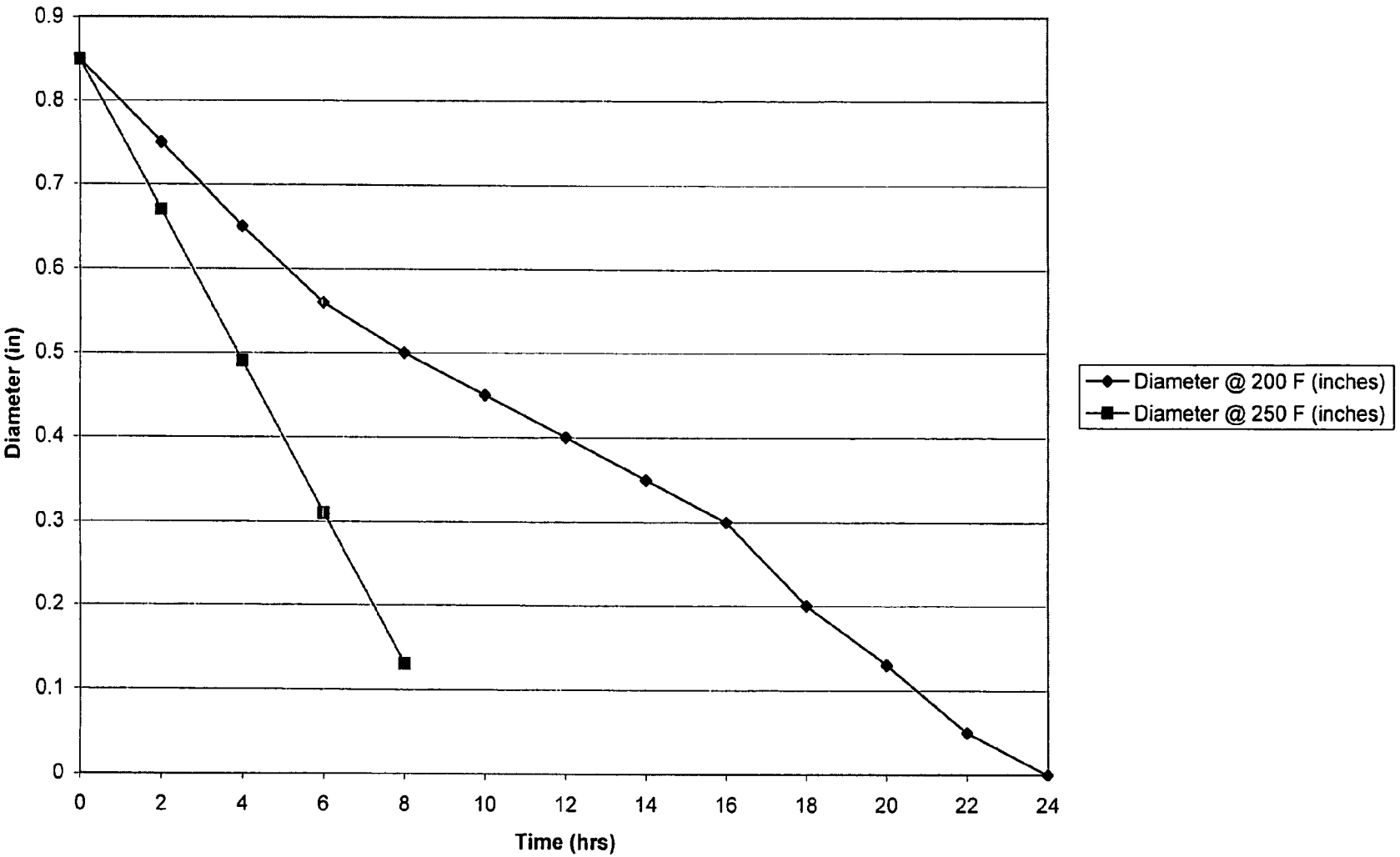
FIG. 5 illustrates the solubility profile of ball sealers of the present invention at 200° F. and 250° F. in diesel fuel.

FIG. 4 shows another aspect of the ball sealer of the present invention. As shown therein, in cross-section, the ball sealer 40 has a hollow core 46, which is substantially surrounded by a polymeric composition 42 comprising ethylene and an alpha-olefin, and further comprises filler material 44. Hollow core 46 has a diameter, d, and a radius, r, such that the thickness 48 of the polymeric composition 42 range from about 1/10 of the total ball diameter, to about 3/4 of the total ball diameter.

The following examples are included to demonstrate preferred embodiments of the invention. It should be appreciated by those of skill in the art that the techniques disclosed in the examples which follow represent techniques discovered by the inventors to function well in the practice of the invention, and thus can be considered to constitute preferred modes for its practice. However, those of skill in the art should, in light of the present disclosure, appreciate that many changes can be made in the specific embodiments which are disclosed and still obtain a like or similar result without departing from the scope of the invention.

EXAMPLES

Seal longevity, general and time incremental solubility, and mechanical integrity tests were performed on various ball sealers. The tests involved subjecting the balls to overbalance pressures of 1000 psi and 3000 psi. Throughout the test, a continuous flow of refined diesel was maintained across the face of the ball sealers. Same test procedure was repeated with crude oil and acidified refined diesel and crude oil.

CHART 1

Mechanical Integrity Test Results

| Test Number | Pressure (psi) | Failure Point | Nature of Failure |
|---|---|---|---|
| 1 | 1000 | None | Did not fail under the given conditions |
| 2 | 3000 | | Balls extruded through the perforation and formed a mushroom shaped mass after failure |

CHART 2

General Solubility Test Results

| Fluid | Temperature (° F.) | Dissolution (%) |
|---|---|---|
| 2% KCl | 250 | 99.9 |
| | 300 | 99.8 |
| 2% KCl + 15% | 250 | 99.6 |
| HCL | 300 | 95.6 |
| 2% KCl + 28% | 250 | 96.9 |
| HCL | 300 | 99.2 |

Mechanical Integrity Test

A lab scale mechanical integrity test was performed to simulate sealing a perforation. The assembly was contained within an oven at a specified temperature. A brine reservoir for feeding the pump was located inside the oven. The tubing and valves were configures so that all exit flow was via the perforation. An optional core plug may be placed downstream of the perforation. For these examples the core plug was omitted. Then, flow was diverted over a mass of ball sealers. The balls were pressurized to seal the perforation. Back pressure builds up behind the ball sealers to the set point pressure. For these tests, back pressures of 1000 and 3000 psi were used (pressures are given in under the specific test section). Leak off is monitored on a 0.01 g precision electronic balance placed at the perforation outlet, for sub-100° C. tests.

The oven is a 12 kW three-phase, triple convection driven system and it is expected that the heat transfer through the steel wall that forms the perforation to the ball is rapid. The onset of ball failure becomes evident between 5 and 10 seconds before failure as effluent release rate increases. Failure is accompanied by a violent release of fluid from the system. For these tests, brine was flowed continuously across the face of the ball sealers, exiting the rig into a pressurized accumulator. The flow rate was 10 cc/minute.

General Solubility Test

Tests were run in a pressurized autoclave under a nitrogen blanket at 1000 psi. Samples weighed on a precision balance to 0.0001 g. First, the solution prepared and the sample ball sealers were placed cold into solution. Then, the vessel containing the solution and sealers was placed inside an autoclave which was placed inside oven. A 1000 psi nitrogen blanket was applied. The oven was heated to required temperature over 30 minutes and held for 48 hours. After 48 hours, the oven was switched off and the autoclave was allowed to cool for 2-3 hours. The nitrogen blanket removed and the suspension was recovered and vacuum filtered across pre-weighed filter paper. The filter paper dried and reweighed. Hence, the percentage solubility of the ball sealers was determined.

Time Incremental Solubility

Time incremental solubility tests were performed to determine the rates of solubility of the modified Bioballs HRs at 250° F. and 300° F. with 2% KCl, 15% HCl/2% KCl, and 28% HCl/2% KCl solutions. The tests were performed in Fann's single end pressure cell at 500 psi. The cell was filled with 100 mls of the desired testing solution. Then, a bioball HR with pre-measured diameter size was placed in the solution. The cell was sealed and placed in the cell jacket preheated to testing temperature and the ball was removed every five hours for diameter size measurements.

Example 1

General Manufacturing Procedure

One or more polymer resins including ENGAGE™ 8402, phenolic NOVOL KK™, and substituted NOVOL KK™ were combined and added to an injection molding machine at a temperature of about 200° F. or greater, depending upon the specific composition. Each of the following examples used ⅞ inch diameter balls were formed with filler material that was low density ceramic powder with dimensions of 0.8 to 0.9 g/cm$^3$. Following molding, the resultant balls were dropped into cool water immediately, then removed and allowed to set. The ball sealers were then tested for dissolution times (solubility) and temperatures, as well as mechanical integrity. The time to failure was measured from the time the ball was exposed to the fluid and the ball simply disintegrated.

Example 2

Ball Sealer with ENGAGE™ 8402

Ball sealers were formed from ENGAGE™ 8402 (The Dow Chemical Co., Midland, Mich.) polyolefin elastomer, using the injection molding technique described above at a temperature of about 320° F. These balls had a high mechanical integrity, and dissolved completely at 200° F. and 250° F.

Example 3

Ball Sealer with ENGAGE™ 7467

Ball sealers were formed from ENGAGE™ 7467, an ethylene-butene copolymer (The Dow Chemical Co.), using the injection molding technique of Example 1 at a temperature of about 250° F. Analysis of the resultant balls at 200° F. showed that the ball sealers dissolved very rapidly, and left a thick, insoluble gelatinous residue. No analysis was done at 250° F.

Example 4

Ball Sealer with NEVCHEM® 100

Ball sealers were formed from NEVCHEM® 100 (Neville Chemical Co., Pittsburgh, Pa.), an alkylated aromatic hydrocarbon resin, using the injection molding technique of Example 1 at a molding temperature of 200° F. Analysis of the balls formed showed them to be brittle and weak, and they dissolved completely within an hour of addition time at 200° F. No analysis of these balls was done at 250° F.

Example 5

Ball Sealer with NEVCHEM® 2600X

Ball sealers were formed from NEVCHEM® 2600X (Neville Chemical Co., Pittsburgh, Pa.), a thermoplastic hydrocarbon resin, using the injection molding technique of Example 1 at a molding temperature of 230° F. Analysis of the balls formed showed them to be brittle and weak, and they dissolved completely within an hour of addition time at 200° F. No analysis of these balls was done at 250° F.

Example 6

Ball Sealer with NEVCHEM® 100 and ENGAGE™ 8402

Ball sealers were formed from a mixture of 10 wt. % NEVCHEM® 100 and 90 wt. % ENGAGE™ 8402, using the injection molding techniques of Example 1 at a molding temperature of 260° F. Upon analysis, the sample were found to dissolve very rapidly, and to exhibit very little mechanical strength.

Example 7

Ball Sealer with NEVCHEM® 2600X and ENGAGE™ 8402

Ball sealers were formed from a mixture of 10 wt. % NEVCHEM® 2600X and 90 wt. % ENGAGE™ 8402, using the injection molding techniques of Example 1 at a molding temperature of 275° F. Analysis showed the resultant ball sealers to have good mechanical integrity and an excellent solubility profile.

Example 8

Mechanical Integrity Test Results of Oil-Soluble Ball Sealers

Ball sealers comprised of varying percentages of NEVCHEM® resin blended with either ENGAGE™ 8402 or ENGAGE™ 7467 were prepared according to Example 1, and were tested for solubility and mechanical integrity at pressures ranging from about 1,000 psi to about 3,000 psi at temperatures from 200° F. to 250° F. The results are shown in Table 1, below. Each of the ball sealers was tested until failure. This table shows which blends were most likely to fail quickly and which were more likely to be resilient over longer time periods or higher pressure.

TABLE 1

Mechanical Integrity Test Results.

| Test No. | NEVCHEM ® resin | Testing Pressure (psi) | Temperature Type (° F.) | Time to Failure | Total Test Duration |
|---|---|---|---|---|---|
| 1 | NevChem 100 | 1,000 | 200 | 6 min (at 70° C.) | 3 h, 6 min. |
| 2 | NevChem 2600X | 1,000 | 200 | 21 min (at 93° C.) | 4 h, 21 min. |
| 3 | NevChem 100 | 1,000 | 250 | 6 min (at 90° C.) | 3 h, 6 min. |
| 4 | NevChem 2600 X | 1,000 | 250 | 37 min (at 93° C.) | 3 h, 37 min. |
| 5 | NevChem 100 | 3,000 | 200 | 0 min | 0 min |
| 6 | NevChem 2600 X | 3,000 | 200 | 48 min (at 70° C.) | 3 h, 48 min. |
| 7 | NevChem 2600 X | 3,000 | 250 | 24 min (at 90° C.) | 3 h, 24 min. |

All of the compositions and methods disclosed and claimed herein can be made and executed without undue experimentation in light of the present disclosure. While the compositions and methods of this invention have been described in terms of preferred embodiments, it will be apparent to those of skill in the art that variations may be applied to the compositions and methods and in the steps or in the sequence of steps of the methods described herein without departing from the concept and scope of the invention. More specifically, it will be apparent that certain agents which are chemically and/or structurally related may be substituted for the agents described herein while the same or similar results would be achieved. All such similar substitutes and modifications apparent to those skilled in the art are deemed to be within the scope and concept of the invention.

What is claimed is:

1. A ball sealer for substantially plugging perforations in a well casing, the ball sealer comprising:

a polymeric composition comprised of a copolymer of ethylene and an alpha-olefin; and filler material, wherein the filler material is added to the polymeric composition in an amount sufficient to provide the ball sealer with a density of about 0.70 g/cc to about 1.5 g/cc, the ball sealer having an average diameter of about 0.2 to 5 inches.

2. A ball sealer for substantially plugging perforations in a well casing in a subterranean formation, the ball sealer comprising a mass of agglomerates having an average diameter of about 0.2 to 5 inches for substantially plugging these perforation when deposited in the well casing by a carrier liquid, wherein the agglomerates are formed from a mixture of a filler and a copolymer of ethylene and a $C_3$-$C_{12}$ alpha olefin, the copolymer being selected so that the shaped agglomerates have a density of about 0.7 g/cc to 1.5 g/cc, are deformable to substantially seal the these perforations when exposed to ambient conditions in the subterranean formation of about 100° F. (38° C.) to 300° F. (149° C.), a pressure of about 10,000 to 20,000 psi and a differential pressure across the perforations of about 1,000 to 3,000 psi, and are degradable when exposed to subterranean hydrocarbon production fluids at pH's of about 7 or less.

3. A process for temporarily plugging perforations in a well casing in a subterranean formation for allowing a wellbore stimulation treatment, the temperature of the subterranean formation at the perforations being about 100° F. (38° C.) to 300° F. (149° C.), the pressure of the subterranean formation at the perforations being about 10,000 to 20,000 psi and the differential pressure across the perforations being about 1,000 to 3,000 psi, the process comprising charging a degradable ball sealer into the well casing by means of a carrier liquid and thereafter allowing the degradable ball sealer to degrade through exposure to a subterranean hydrocarbon production fluid at a pH of about 7 or less, wherein the ball sealer comprises a mass of agglomerates having an average diameter of about 0.2 to 5 inches for substantially plugging these perforation when deposited in the well casing by the carrier liquid, the agglomerates being formed from a mixture of a filler and a hydrocarbon polymer having a melt flow index according to ASTM Test Method D1238 of 1.0 to 35, the filler and hydrocarbon polymer being selected so that the shaped agglomerates have a density of about 0.7 g/cc to 1.5 g/cc, are deformable to substantially seal the these perforations when exposed to ambient conditions in the subterranean formation of about 100° F. (38° C.) to 300° F. (149° C.) and a differential pressure of about 1,000 to 3,000 psi, and are degradable when exposed to subterranean hydrocarbon production fluids at pH's of about 7 or less.

4. Ball sealers for substantially plugging perforations in a well casing during a well treatment carried out on the well itself, or the wellbore or reservoir in which the well is contained, the well treatment to be carried out under a set of ambient conditions including temperatures of about 100° F. (38° C.) to 300° F. (149° C.) and pressures of about 10,000 to 20,000 psi, the ball sealers to be delivered to and forced into these perforations by an aqueous carrier liquid creating a differential pressure across these perforations of about 1,000 to 3,000 psi, the ball sealers comprising a mass of shaped polymer objects having an average diameter of about 0.2 to 5 inches and a density of about 0.7 g/cc to 1.5 g/cc, the shaped polymer objects being formed from a synthetic organic polymer component which is sufficiently tough so that these shaped articles substantially resist degradation during this well treatment, sufficiently pliable so that the differential pressure of the aqueous carrier liquid causes these shaped articles to substantially plug these perforations, and soluble in hydrocarbon fluids so that, after the well treatment is finished and production of subterranean hydrocarbon fluid is begun, these shaped articles degrade upon exposure to this subterranean hydrocarbon fluid at pH's of about 7 or less.

5. The ball sealers of claim 4, wherein the shaped polymer objects have an average diameter of about ⅝ inch to 1 ¼ inches.

6. The ball sealers of claim 4, wherein the agglomerates are formed by injection molding.

7. The ball sealer of claim 4, wherein the polymer component is a hydrocarbon polymer.

8. The ball sealers of claim 7, wherein the hydrocarbon polymer is at least one of an ethylene-α-olefin copolymer, a linear styrene-isoprene-styrene copolymer, an ethylene-butadiene copolymer, a styrene-butadiene-styrene copolymer, and a copolymer having styrene endblocks and ethylene-butadiene or ethylene-butene midblocks.

9. The ball sealers of claim 8, wherein the hydrocarbon polymer is an ethylene-α-olefin copolymer having styrene end blocks.

10. The ball sealers of claim 8, wherein the hydrocarbon polymer is a copolymer of ethylene and a $C_3$-$C_{12}$ alpha olefin.

11. The ball sealers of claim 7, wherein the hydrocarbon polymer comprises ethylene and at least one comonomer selected from 1-propene, 1-butene, 4-methyl -1-pentene, 1 -pentene, 1 -hexene, 1 -octene, 1 -decene, and 1 -dodecene.

12. The ball sealers of claim 7, wherein the hydrocarbon polymer is an ethylene-octene copolymer, an ethylene-hexene copolymer, an ethylene-butene copolymer or an ethylene-pentene copolymer.

13. The ball sealers of claim 12, wherein the hydrocarbon polymer is an ethylene-butene copolymer.

14. The ball sealers of claim 4, wherein the polymer component has a Shore A Hardness according to ASTM D-2240 of about 55 to about 90, a melt flow rate of about 0.2 to 2.0 g/10 mm. and an Ultimate Tensile Elongation according to ASTM D-638 of about 400% to about 950%.

15. The ball sealers of claim 4, wherein the shaped polymer objects contain a filler.

16. A composition for substantially plugging perforations in a well casing during a well treatment carried out on the well itself, or the wellbore or reservoir in which the well is contained, the well treatment to be carried out under a set of ambient conditions including temperatures of about 100° F. (38° C.) to 300° F. (149° C.) and pressures of about 10,000 to 20,000 psi, the composition comprising an aqueous carrier liquid and ball sealers to be delivered to and forced into these perforations by the aqueous carrier liquid at a differential pressure across these perforations of about 1,000 to 3,000 psi, the ball sealers comprising a mass of shaped polymer objects having an average diameter of about 0.2 to 5 inches and a density of about 0.7 g/cc to 1.5 g/cc, the shaped polymer objects being formed from a synthetic organic polymer component which is sufficiently tough so that these shaped articles substantially resist degradation during this well treatment, sufficiently pliable so that the differential pressure of the aqueous carrier liquid causes these shaped articles to substantially plug these perforations, and soluble in hydrocarbon fluids so that, after the well treatment is finished and production of subterranean hydrocarbon fluid is begun, these shaped articles degrade upon exposure to this subterranean hydrocarbon fluid at pH's of about 7 or less.

17. The composition of claim 16, wherein the shaped polymer objects have an average diameter of about ⅝ inch to 1 ¼ inches.

18. The composition of claim 17, wherein the polymer component is a hydrocarbon polymer.

19. The composition of claim 18, wherein the hydrocarbon polymer is at least one of an ethylene-α-olefin copolymer, a linear styrene-isoprene-styrene copolymer, an ethylene-butadiene copolymer, a styrene-butadiene-styrene copolymer, and a copolymer having styrene endblocks and ethylene-butadiene or ethylene-butene midblocks.

20. The composition of claim 18, wherein the hydrocarbon polymer is a copolymer of ethylene and a $C_3$-$C_{12}$ alpha olefin.

21. The composition of claim 18, wherein the hydrocarbon polymer is an ethylene-octene copolymer, an ethylene-hexene copolymer, an ethylene-butene copolymer or an ethylene-pentene copolymer.

22. The composition of claim 18, wherein the hydrocarbon polymer is an ethylene-butene copolymer.

23. A process for temporarily plugging perforations in a well casing in a subterranean formation during a well treatment carried out on the well itself, or the wellbore or reservoir in which the well is contained, the well treatment to be carried out under a set of ambient conditions including temperatures of about 100° F. (38° C.) to 300° F. (149° C.) and pressures of about 10,000 to 20,000 psi, the process comprising charging a degradable ball sealer into the well casing by means of an aqueous carrier liquid and thereafter allowing the degradable ball sealer to degrade through exposure to a subterranean hydrocarbon production fluid at a pH of about 7 or less, the ball sealers comprising a mass of shaped polymer objects having an average diameter of about 0.2 to 5 inches and a density of about 0.7 g/cc to 1.5 g/cc, the shaped polymer objects being formed from a synthetic organic polymer component which is sufficiently tough so that these shaped articles substantially resist degradation during this well treatment, sufficiently pliable so that the aqueous carrier liquid causes these shaped articles to substantially plug these perforations when the carrier liquid exerts a differential pressure across these perforation of about 1,000 to 3,000 psi, and soluble in hydrocarbon fluids so that, after the well treatment is finished and production of subterranean hydrocarbon fluid is begun, these shaped articles degrade upon exposure to this subterranean hydrocarbon fluid at pH's of about 7 or less.

24. The process of claim 23, wherein the shaped polymer objects have an average diameter of about ⅝ inch to 1 ¼ inches.

25. The process of claim 23, wherein the polymer component is a hydrocarbon polymer.

26. The process of claim 25, wherein the hydrocarbon polymer is at least one of an ethylene-α-olefin copolymer, a linear styrene-isoprene-styrene copolymer, an ethylene-butadiene copolymer, a styrene-butadiene-styrene copolymer, and a copolymer having styrene endblocks and ethylene-butadiene or ethylene-butene midblocks.

27. The process of claim 25, wherein the hydrocarbon polymer is a copolymer of ethylene and a $C_3$-$C_{12}$ alpha olefin.

28. The process of claim 25, wherein the hydrocarbon polymer is an ethylene-octene copolymer, an ethylene-hexene copolymer, an ethylene-butene copolymer or an ethylene-pentene copolymer.

29. The process of claim 28, wherein the hydrocarbon polymer is an ethylene-butene copolymer.

30. The process of claim 23, wherein the shaped polymer objects contain a filler.

* * * * *

UNITED STATES PATENT AND TRADEMARK OFFICE

CERTIFICATE OF CORRECTION

PATENT NO. : 7,647,964 B2
APPLICATION NO. : 11/640813
DATED : January 19, 2010
INVENTOR(S) : Akbar et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1 days.

Signed and Sealed this

Twenty-eighth Day of December, 2010

David J. Kappos

David J. Kappos
*Director of the United States Patent and Trademark Office*